US005320923A

United States Patent [19]

Nguyen

[11] Patent Number: 5,320,923

[45] Date of Patent: Jun. 14, 1994

[54] REUSABLE, POSITIVE-CHARGING ORGANIC PHOTOCONDUCTOR CONTAINING PHTHALOCYANINE PIGMENT, HYDROXY BINDER AND SILICON STABILIZER

[75] Inventor: Khe C. Nguyen, Milpitas, Calif.

[73] Assignee: Hewlett-Packard Company, Palo Alto, Calif.

[21] Appl. No.: 10,101

[22] Filed: Jan. 28, 1993

[51] Int. Cl.[5] ..... G03G 5/06; G03G 5/04

[52] U.S. Cl. ..... 430/78; 430/96

[58] Field of Search ..... 430/78, 96

[56] References Cited

U.S. PATENT DOCUMENTS

| | | | |
|---|---|---|---|
| 3,437,481 | 4/1969 | Graver et al. | 430/96 X |
| 3,640,710 | 2/1972 | Mammino et al. | 430/96 X |
| 4,218,528 | 8/1980 | Shimada et al. | 430/96 X |
| 4,559,287 | 12/1985 | McAneney et al. | 430/59 |
| 4,734,348 | 3/1988 | Suzuki et al. | 430/96 |
| 4,891,288 | 1/1990 | Fujimaki et al. | 430/58 |
| 4,923,775 | 5/1990 | Schank | 430/59 |
| 5,069,993 | 12/1991 | Robinett et al. | 430/58 |
| 5,087,540 | 2/1992 | Murakami et al. | 430/58 |
| 5,258,252 | 11/1993 | Sakai et al. | 430/96 X |
| 5,264,312 | 11/1993 | Stolka et al. | 430/96 X |

FOREIGN PATENT DOCUMENTS

| | | | |
|---|---|---|---|
| 55553 | 3/1988 | Japan | 430/78 |

*Primary Examiner*—Roland Martin

[57] ABSTRACT

An organic, positive-charging photoconductor for laser printers is disclosed. The photoconductor has a conductive substrate, a hydroxy-containing binder which forms a layer greater than or equal to about 1 micron thick on the substrate, a phthalocyanine pigment uniformly distributed throughout said binder, and a reactive stabilizer containing silicon, also uniformly distributed throughout said binder. The silicon-containing stabilizer reacts with the hydroxy group in the binder, the effect of which is to improve the electrical stability of the photoconductor in the severe laser printing electrophotographic environment, and to improve surface release characteristics of the photoconductor for more efficient toner image transfer.

15 Claims, 3 Drawing Sheets

(AFTER 1000 CYCLES)

(FIRST CYCLE)

REUSABLE, POSITIVE-CHARGING ORGANIC PHOTOCONDUCTOR CONTAINING PHTHALOCYANINE PIGMENT, HYDROXY BINDER AND SILICON STABILIZER

BACKGROUND OF THE INVENTION

1. Field of the Invention

This invention relates generally to image transfer technology and more specifically to electrophotography. The invention is a positive charging, organic photoconductor material with superior surface release characteristics for dry and liquid toner electrophotography.

2. Related Art

In electrophotography, a latent image is created on the surface of an insulating, photoconducting material by selectively exposing areas of the surface to light. A difference in electrostatic charge density is created between the areas on the surface exposed and unexposed to light. The visible image is developed by electrostatic toners containing pigment components and thermoplastic components. The toners are selectively attracted to the photoconductor surface either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same polarity, but different levels of charge.

A sheet of paper or intermediate transfer medium is given an electrostatic charge opposite that of the toner and passed close to the photoconductor surface, pulling the toner from the photoconductor surface onto the paper or intermediate medium still in the pattern of the image developed from the photoconductor surface. A set of fuser rollers melts and fixes the toner in the paper, subsequent to direct transfer, or indirect transfer when using an intermediate transfer medium, producing the printed image.

There is a demand in the laser printer industry for multi-colored images. Responding to this demand, designers have turned to liquid toners, with pigment components and thermoplastic components dispersed in a liquid carrier medium, usually special hydrocarbon liquids. With liquid toners, it has been discovered, the basic printing colors —yellow, magenta, cyan and black, may be applied sequentially to a photoconductor surface, and from there to a sheet of paper or intermediate medium to produce a multicolored image.

The important photoconductor surface, therefore, has been the subject of much research and development in the electrophotography art. A large number of photoconductor materials have been disclosed as being suitable for the electrophotographic photoconductor surface. For example, inorganic compounds such as amorphous silica ($SiO_2$), arsenic selenite ($As_2Se_3$), cadmium sulfide (CdS), selenium (Se), titanium oxide ($TiO_2$) and zinc oxide (ZnO) function as photoconductors. However, these inorganic materials do not satisfy modern requirements in the electro-photography art of low production costs, high-speed response to laser diode or other light-emitting-diode (LED) and safety from non-toxicity.

Therefore, recent progress in the electrophotoqraphy art with the photoconductor surface has been made with organic materials as organic photoconductors (OPC). Typically, the OPC's in the current market are of the negative charging type with a thin charge generation material layer beneath a thicker charge transport material layer deposited on top of the charge generation layer. The negative charging OPC's perform well for xerographic copiers and printers in the following applications:

a. Low end (4–10 copies per minute) and high end (more than 50 copies per minute) xerographic systems using dry powder developers of one or two colors, or using liquid developers for black and white copies only; and, b. High image quality (above 1800 DPI) color proofing, lithographic plate printing and master xero-printing systems with life expectancies of less than 100 cycles.

However, prior art negative charging OPC's also have several drawbacks, namely:

1. Large amounts of ozone are generated in the negative corona charging process, creating environmental concerns. This problem has been addressed by installing ozone absorbers like activated carbon filters, and by using contact negative charging instead of corona charging. These ozone remediation approaches, however, have drawbacks of their own and are not attractive commercial solutions.

2. Negative corona charging generally results in less charge pattern uniformity compared to positive corona charging. Lower charge pattern uniformity in turn results in more noise and less definition in the final image.

3. In small particle toner processes, including fine dry powder and liquid toner processes, designers have been able to develop more charge stability in positively charged toners than in negatively charged toners. Therefore, positive charging OPC's are preferred for a discharged area developed image as in laser printers.

Specific morphologies of phthalocyanine pigment powder have been known to exhibit excellent photoconductivity. These phthalocyanine pigments have been used as a mixture in polymeric binder matrices in electrophotographic photoconductors, deposited on a conductive substrate. In these phthalocyanine/binder photoconductors, the photo-generation of charge and the charge transport occur in the particles of the phthalocyanine pigment while the binder is inert. Therefore, the photoconductor may be made of a single layer of phthalocyanine/binder. These single-layer photoconductors are known to be very good positive charging OPC's due to the hole (positive charge) transportability of the phthalocyanine pigment.

In these single-layer photoconductors, then, there is no need to add charge transport molecules, nor to have a separate charge transport layer. The phthalocyanine pigment content may be in the range of about 10–30 wt. %, high enough to perform both charge generation and charge transport functions, with the binder content being in the range of about 90–70 wt. %. The single photoconductor layer is usually more than about 3 microns (um) thick in order to achieve the required charge acceptance and resulting image contrast.

Also, it is known to use phthalocyanine pigment as a charge generation component in a multi-layer photoconductor. Today, the commercially available OPC for digital electrophotography, wherein the writing head is LED array or laser diode, uses such a multi-layer photoconductor. The charge generation layer containing the phthalocyanine pigment is usually less than 1 micron (um) thick. A charge transport layer about 20–30 microns (um) thick and containing transport molecules other than the phthalocyanine pigment, is overcoated on top of the charge generation layer.

These types of multi-layer OPC's, however, are only used as negative charging ones, so they have all the drawbacks of negative charging OPC's discussed above. So, there remains a strong incentive for the development of a phthalocyanine pigment positive charging OPC.

One response by the industry to this incentive has been to investigate a positive-charging, multi-layer OPC with an electron transport molecule in the upper layer which must be an electron acceptor molecule and an electron transporter molecule under the application of a positive electric field. See, for example, the disclosure of U.S. Pat. No. 4,559,287 (McAneney, et al.). These types of OPC's use derivatives of fluorenylidene methane, for example, as the electron acceptor and transport molecule. These types of molecules, however, exhibit poor solubility, resulting in recrystallization in the OPC forming mixture during coating, poor compatibility with popular binders, and poor reaction yield resulting in high production costs. Also, these types of molecules tend to be highly carcinogenic, resulting in safety risks to workers and users and therefore, low market receptivity.

Also, U.S. Pat. No. 5,087,540 (Murakami et al.) discloses a positive charging, single-layer photoconductor for electrophotography which has X-type and/or T-type phthalocyanine compound dispersed partly in a molecular state and partly in a particulate state in a binder resin. To make the dispersion, the phthalocyanine compound is agitated in a solvent with the binder resin for from several hours to several days. This approach, therefore, has manufacturing drawbacks.

Another response by the industry to the incentive for the development of a phthalocyanine type positive charging OPC has been to investigate a multi-layer OPC wherein the relative positions of the charge generation and transport layers are reversed. See, for example, the disclosure of U.S. Pat. No. 4,891,288 (Fujimaki et al.). These types of OPC's, however, require a protective overcoat to avoid mechanical damage to the OPC because the upper pigment-containing layer is very vulnerable to the development component, the transfer medium component and the cleaning component in the electrophotographic system. These overcoat layers have problems of their own, increasing the residual voltage of the photoconductor and increasing its electrical instability. See, for example, the disclosures of U.S. Pat. Nos. 4,923,775 (Schank) and 5,069,993 (Robinette, et al.).

Therefore, it is an object of this invention to provide a phthalocyanine type positive-charging OPC which exhibits stable electrical properties, including charge acceptance, dark decay and photodischarge, in a high cycle, high severity electrophotographic process. Modern digital imaging systems wherein the writing head is LED array or laser diode, have very high light intensities (about 100 ergs/cm$^2$) over very short exposure time spans (less than 50 nano seconds), resulting in severe conditions for the OPC compared to optical input copiers with light intensities between about 10–30 ergs/cm$^2$ and exposure times between about several hundred micro-seconds to mili-seconds.

Unfortunately, there is no product on the market today which provides such stable electrical properties. This is because the phthalocyanine type positive-charging OPC exhibits instability when it is frequently exposed to the corona charger and the intense light source in the electrophotographic process. I have discovered this instability to be more pronounced at the strong absorption, high light intensity, short exposure time conditions required for the laser printing process. The instability is exhibited in the significant increase of the dark decay after a small number of repeat cycles of laser printing. Also, the instability is exhibited in the decrease in surface potential. These instabilities cause deleterious changes in image contrast, and raise the issue of the reliability of image quality.

Also, I have discovered that these instabilities in the phthalocyanine/binder photoconductor seem to be independent of the chemical structure or morphology of the pigment. Instead, they appear to be dependent on the nature of the contact between individual pigment particles. These observations of mine have been made only recently, and there is no report or suggestion in the prior art about how to effectively address and solve the problem of photoconductor instability in the high cycle, high severity electrophotographic process.

Preferably, desirable electrophotographic performance may be defined as high charge acceptance of about 30–100 V/um$^2$, low dark decay of less than about 5 V/sec., and photodischarge of at least 70% of surface charge with the laser diode beam of 780 nm or 830 nm frequency, through the optical system including beam scanner and focus lenses, synchronized at 0.05 micro seconds for each beam.

When conventional binders for the phthalocyanine pigment, such as acrylic resins, phenoxy resins, vinyl polymers including polyvinylacetate and polyvinyl butyryl, polystyrene, polyesters, polyamides, polyimides, polycarbonates, methylmethacrylates, polyurethanes, polyureas, melamine resins, polysulfones, polyarylates, diallylphthalate resins, polyethylenes and halogenated polymers, including polyvinylchloride, polyfluorocarbon, etc., are used, acceptable charge acceptance and photodischarge are obtained, provided a good dispersion of the pigment in the binder is obtained. However, among these polymers which result in good performance for charge acceptance and photodischarge, none of them exhibit the desirable stability under the LED array or laser diode exposure conditions. Also, any binders, and accompanying solvents, which do not form a stable dispersion with the phthalocyanine pigment usually exhibit very slow charge acceptance, high residual voltage, or high dark decay, and are therefore unacceptable.

Another important object of the present invention is to provide a positive-charging OPC having superior surface release characteristics. In the context of this invention, superior surface release characteristics means that the photoconductor surface has low adhesion which permits easier transfer of the toner particles image off the photoconductor surface onto the plain paper or intermediate transfer medium. The current electrophotography requires the plain paper as the final medium for the image, i.e. the toner image on the photoreceptor must be well transferred to the plain paper by known arts such as electrostatic charge or non-electrostatic thermally assisted transfer. The high transfer efficiency toning systems have the benefit of high image density on the plain paper, with the high image quality being due to a completely transferred image which results in reduced efforts for cleaning the photoreceptor surface. The requirement of superior surface release characteristics also is crucial for high speed printing systems, especially for small particle developers such as dry microtoner (particle size less than 5um) and liquid toner (particle size in the submicron range).

In the last decade, there have been a lot of efforts to enhance image transfer efficiency in the electrophotographic systems, such as release surface coated toner, intermediate transfer concepts and systems and temporary release coating on the surface of the photoconductor.

Even so, the image transfer problems have not been completely solved as the above-proposed solutions give rise to other problems. For example, higher cost and reduced printing speed are encountered with the intermediate transfer approach. Also, the release surface coated toner technologies encounter the difficulty of controlling particle size and poor fusing effect as the release coating materials are highly crosslinking polymers. Also, the temporary release coating of the photoreceptor approach is not a suitable one from the service-free perspective.

The photoconductor of this invention aims at a solution for a permanent, reusable organic photoconductor having superior surface release characteristics, and therefore, high efficiency toner particle transfer. This approach is found to be very effective in the simplification of the plain paper imaging process at low cost.

SUMMARY OF THE INVENTION

I have invented a stable, safe phthalocyanine/binder positive-charging OPC for LED array or laser diode digital electrophotographic systems. I have discovered that, for phthalocyanine pigments, specific types of binder resins containing certain types of hydroxy group (—OH) and silicon-containing stabilizer additives with functional groups which chemically bond to the hydroxy group of the binder result in an electrically stable OPC with superior surface release characteristics. The hydroxy group containing-binder is selected from water insoluble plastics such as polyvinyl acetal, phenolic resins, phenoxy resins, cellulose and its derivatives, copolymers of vinyl alcohol, hydroxylated polymers and copolymers of hydroxy monomers and silicon resins. The silicon-containing stabilizer additive is selected from cross-linkable resins:

which can react with the hydroxy group of the binder; and which can maintain the stability of the dispersion of the phthalocyanine pigment.

The stabilizer may be selected from reactive polysiloxanes, organo-silane compounds, and porous fillers containing silicon atoms.

The combination of the hydroxy group-containing binder and the reactive silicon-containing stabilizer increases the electrical stability of the phthalocyanine pigment when it is dispersed in the binder as a single-layer photoreceptor. Instability in this system is likely due to electrical contact between individual phthalocyanine pigment particles, regardless of their specific chemical structure or morphology. I have observed this instability with numerous phthalocyanine pigments, including metal-free phthalocyanine, titanyl phthalocyanine, vanadyl phthalocyanine, copper phthalocyanine, zinc phthalocyanine, magnesium phthalocyanine, bromo-indium phthalocyanine, chloro-indium phthalocyanine, etc. The instability increases with decreasing pigment particle size. Also, the instability increases with increased pigment loading. I discovered that using a hydroxy-containing binder reacted with a silicon-containing stabilizer stabilizes the surface charge for a photoconductor containing a large variety of phthalocyanine pigments with particles in the submicron range and exhibiting metastable crystal form by having absorption maxima in the infrared or near infrared range.

The hydroxy group-containing binder and the reactive silicon-containing stabilizer must be carefully selected so that they are compatible and maintain the dispersion stability of the phthalocyanine pigment during their formulation and substrate coating process.

With these criteria for coating uniformity and electrophotographic performance, only a limited number of effective binder/stabilizer combinations may be selected for my invention.

DESCRIPTION OF THE PREFERRED EMBODIMENTS

Figure 1:
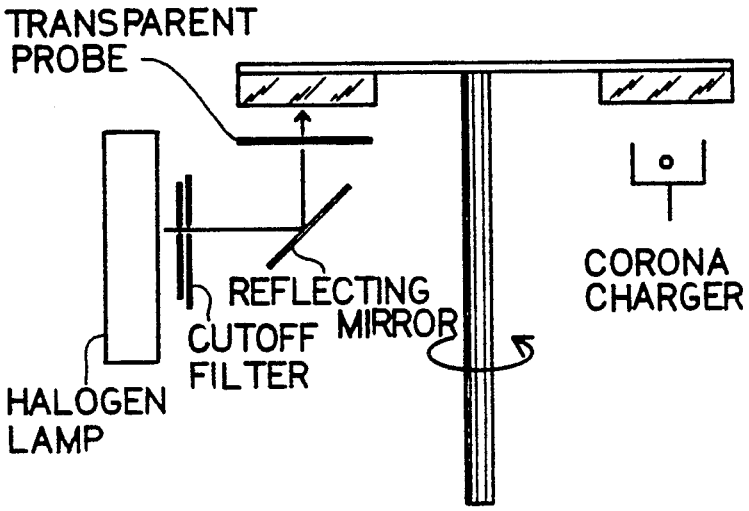
FIG. 1 is a schematic representation of an OPC screening test stand used in my worked Examples.

The components of my photoconductor, namely: phthalocyanine pigment, hydroxy-containing binder, reactive silicon-containing stabilizer and optional solvents need to be mixed separately and then mixed together in order to maximize the beneficial stabilizing effect.

Preferably, the phthalocyanine pigment component has the general formula:

$$M-PcX_n \qquad (A)$$

Where

M = hydrogen (metal free), Cu, Mg, Zn, TiO, VO, InY (Y = halogen, Cl, Br, I, F)

X = halogen (Cl, Br, I, F), nitro —$NO_2$, cyano—CN, sulfonyl —$SO_2$, alkyl, alkoxy, and

N = 0–4.

The phthalocyanine pigment component may be a single pigment selected from this group, or a combination of two or more pigments from this group.

For example, the phthalocyanine pigment is first premixed with solvent and silicon stabilizer by using ceramic, glass, table salt or metal beads as milling media. The pigment grinding equipment may be selected from the conventional equipment, such as ball mill, sand mill, paint shaker, attritor, homogenizer, Sweeco mill TM, small media mill, etc. These milling procedures are able to provide good dispersion condition of the pigment. It should be noted that good dispersion of the pigment is defined as the average particle size of the pigment in the dispersion being in the sub micron range.

The silicon stabilizer may be a polysiloxane selected from the group having the general formula:

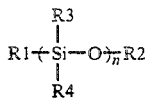

(B)

Where $R_1$, $R_2$=hydrogen, hydroxy —OH, amino —$NH_2$, alkyl, amino-alkyl, carboxylic, carbinol, aryl, arylamino;

$R_3$, $R_4$=hydrogen, alkyl, fluoroalkyl, aryl, and n>50.

The polysiloxane may be a combination of two or more types of polysiloxanes selected from this group.

The silicon stabilizer may also be an organo-silane compound selected from the group having the general formula:

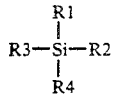

(C)

Where $R_1$, $R_2$, $R_3$, $R_4$=hydrogen, alky, alkoxy, aryl, alkene, amino, halogen, hydroxy, carboxilic, acetate, alkene, oxide, mercapto, ether, fluoroalkyl, cyano and cyanoalkyl.

The organo-silane compound may be a combination of two or more types of organo-silanes selected from this group.

The silicon stabilizer may also be porous fillers containing silicon atoms selected from the group of hydrophillic colloidal silica, hydrophobic colloidal silica, SiC powder and SiN powder.

The porous filler containing silicon atoms may be a combination of two or more types of fillers selected from this group.

The premix of the pigment with the silicon stabilizer tends to strongly adsorb the stabilizer molecule on the surface of the pigment to make the charging stabilization of the photoconductor more effective.

The premixed phthalocyanine pigment - silicon stabilizer is then added with the hydroxy binder solution and slightly milled to achieve the final coating solution. The whole mixture, pigment/silicon stabilizer/hydroxy binder, exhibits excellent dispersion stability for from several months to a year. In some cases, it is necessary to let the dispersion remain calm for a number of days before the coating in order to achieve the good uniformity of the coatings, as well as the desirable xerographic performance. I refer to the calm time as the incubation period. Prematurely incubated samples exhibited high dark decay and short life, as well as poor surface release. This characteristic's incubation period is believed to be necessary due to the interaction between the silicon stabilizer and the hydroxy binder.

The coating solution is applied to the conductive substrate in a conventional manner, like by dipping or casting, for example. Then, the applied film must be cured, with higher temperature, for example, at about 70°-150° C. to initiate the reaction between the binder and the stabilizer. Other curing techniques, like electron beam, UV or X-ray curing, for example, may also be used. Depending upon the type of silicon stabilizer, the curing process may also be done with moisture as in hydrolysis curing. Ordinary curing conditions do not seem to inhibit or destroy the functions of the pigment, binder and stabilizer components, and do not have a negative effect on the electrophotographic performance of the OPC.

The reaction between the hydroxy-containing binder and the silicon-containing stabilizer is effective to stop the increased dark decay of the phthalocyanine/binder photoconductor for many cycles, even with severe exposure conditions. However, surface positive charge will decrease after some cycles unless stabilizer molecules are not only in the bulk of the OPC, but also on its surface to provide complete protection. I think this is because positive charges may be injected into the bulk of the OPC through particles of phthalocyanine pigment on the surface of the OPC. For example, I observed that when an OPC is prepared with its outer surface containing 100% stabilizer molecules, and no binder molecules, excellent surface charge stability, even after more than one hundred thousand cycles, is observed.

The reaction between the hydroxy binder and the silicon stabilizer is believed to be the promoter for the superior surface release properties of my OPC, especially when a polymeric silicon stabilizer was used. The polymeric silicon stabilizer exhibits somewhat better release surface than the lower molecular weight stabilizer. Actually, a combination between a polymeric silicon stabilizer, a lower molecular weight stabilizer and silica is most desirable for good release, long lasting release and stable xerographic performance. This type of organic photoconductor is observed to exhibit an excellent xerographic performance, including high charge acceptance with positive corona, low dark decay rate of positive surface charge, excellent electrical stability (no critical change in charging behavior with repeat cycles due to surface charge injection, no change in discharge rate at least for 500K cycles using high speed process above 4 inches per second with visible laser diode 680 nm, IR laser diode 780 nm, or 830 nm) and especially excellent durability of the superior surface release characteristics, even after many cycles.

The phthalocyanine pigment component is present in the range of about 8 wt. % to about 50 wt. %, relative to the hydroxy-containing binder component. The reactive stabilizer component is present in the range of about 0.0015 wt. % to about 95 wt. %, relative to the hydroxy-containing binder component.

Hydroxy-containing binders include:

1) Polyvinyl acetals with general structure (I):

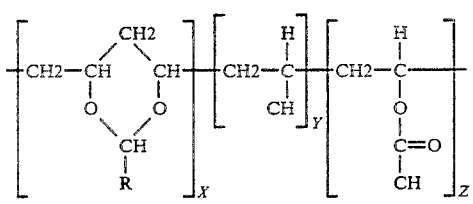

(I)

Where R=alkyl, alkoxy, amino groups, aminoalkyl, cyano —CN, halogen (Cl, Br, I, F), nitro —$NO_2$, hydroxy —OH, aryl and arylalkyl with substituent groups —$NO_2$, —CN, —OH, halogens, amino, heterocyclic groups, etc.

The hydroxy content Y of the polyvinyl acetals may be in the range between 1% and 50%. Two preferred polyvinyl acetals are:

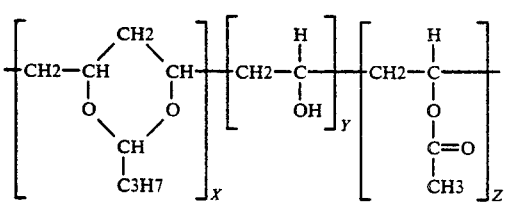

(I-a)

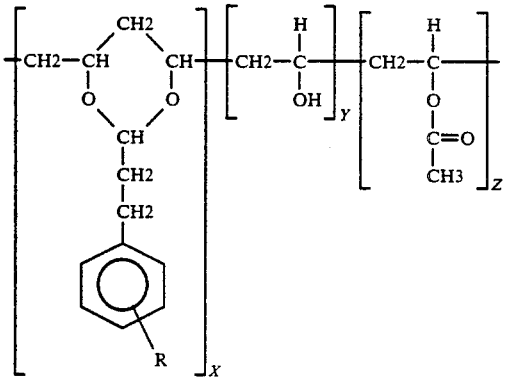

(I-b)

2) Phenolic Resins with general structure (II):

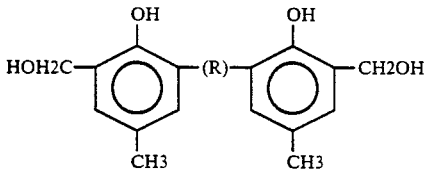

(II)

Where R=alkyl, alkoxy, amino groups, aminoalkyl, cyano —CN, halogen (Cl, Br, I, F), nitro —$NO_2$, hydroxy —OH, aryl and arylalkyl with substituent groups —$NO_2$, —CN, —OH, halogens, amino, heterocyclic groups, etc.

3) Phenoxy resins with general structure (III) or (IV):

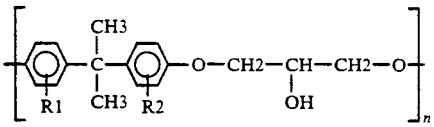

(III)

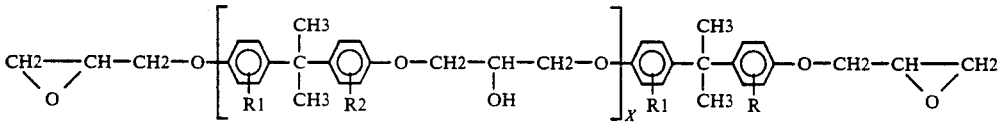

(IV)

Where $R_1$, $R_2$=alkyl, alkoxy, aminoalkyl, halogen (Cl, Br, I, F), nitro —$NO_2$, cyano —CN, and —hydroxy, etc., and 4) Cellulose and its derivatives, including:
cellulose acetate
nitro cellulose, and
butyl cellulose 5) Copolymers of vinyl alcohol with general structure (V) or (VI):

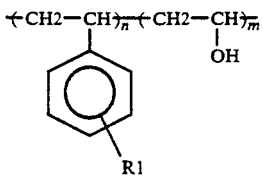

(V)

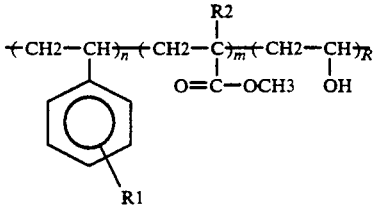

(VI)

Where
$R_1$=alkyl, alkoxy, aminoalkyl, amino, nitro, hydroxy, cyano, halogen, etc. and $R_2$=alkyl, alkoxy, amino, aminoalkyl, nitro, hydroxy, cyano, halogen, etc.

6) Hydroxylated polymers, polystyrenes, polyesters, and polycarbonates, and

7) Copolymers of hydroxy monomers and silicon resin stabilizers.

Silicon-containing stabilizers include:

1) Organo-silane compounds, such as:

1-1) Alkoxy silanes with general structure (VII):

$$R_1—Si(OR_2)_3 \quad \text{(VII)}$$

Where $R_1$, $R_2$=alkyl, alkoxy, ester, epoxy, amino, aryl, halogens, etc.

For example:
1) vinyltris (b methoxyethoxy) silane
2) vinyltriethoxysilane
3) vinyltrimethoxysilane
4) gamma-metacryloxypropyl-trimethoxysilane
5) beta-93,4 (epoxycyclohexyl)-ethylmethoxysilane
6) gamma-glycidoxypropyl-methyldiethoxysilane
7) N-beta (aminoethyl)-gamma-aminopropyltrimethoxysilane
8) N-beta(aminoethyl)-gamma-aminopropylmethyldimethoxysilane
9) gamma-aminopropyl-triethoxysilane
10) N-phenyl-gamma-aminopropyl-trimethoxysilane
11) gamma-mercaptopropyl-trimethoxysilane
12) gamma-chloropropyl-trimethoxysilane
13) tetramethoxysilane
14) methyltrimethoxysilane
15) dimethyldimethoxysilane
16) phenyltrimethoxysilane 17) diphenyldimethoxysilane
18) tetraethoxysilane
19) dimethyldiacetoxysilane
20) vinylmethyldiacetoxysilane
21) ethyltriacetoxysilane
22) methyltriacetoxysilane
23) vinyltriacetoxysilane
24) silicon tetraacetate
25) tetrapropoxysilane
26) methyltriethoxysilane
27) dimethyldiethoxysilane
28) phenyltriethoxysilane
29) diphenyldiethoxysilane
30) isobutyltrimethoxysilane, and
31) decyltrimethoxysilane 1-2) Halogenated silanes
For example:
32) methyltrichlorosilane
33) methyldichlorosilane
34) dimethyldichlorosilane
35) trimethylchloorosilane
36) phenyltrichlorosilane
37) diphenyldichlorosilane
38) vinyltrichlorosilane, and 39) tert-butyldimethylchlorosilane 1-3) Silazanes
Like,
40) hexamethyldisilazane 1-4) Silyl agents
For example:
41) N,O-(bistrimethylsilyl)-acetoamide
42) N,N'-bis(trimethylsilyl)-urea
43) 3-trimethylsilyll-2-oxazolidone
44) N-(trimethylsilylmethyl)-benzylamine
45) trimethylsilylmethylacetate
46) trimethyl silyl methyl phthalimide
47) trimethyl silyl pyrolle
48) bis(N-methylbenzylamido)ethoxymethylsilane
49) bis(dimethylamino)dimethylsilane
50) bis(dimethylamino)methylvinylsilane
51) tris(dimethylamino)methylsilane
52) tris(cyclohexylamino)methylsilane
53) tetramethyldisiloxane
54) 1,3,5,7-tetramethylcyclotetrasiloxane
55) methylhydrocyclosiloxanes
56) methyltris(methylethylketoxime)silane
57) 1,3,5-trivinyl-1,1,3,5,5-pentamethyltrisiloxane
58) 1,3,5,-trivinyl-1,3,5-trimethylcyclotrisiloxane, and
59) tetravinyltetramethylcyclotetrasiloxane 2) Reactive silicon resins
2-1) Poly dimethyl siloxanes with general structure VIII:

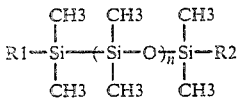
(VIII)

Where $R_1$, $R_2$=H, OH, alkyl, amino, aminoalkyl, carboxylic, carbinol, halogens, alkyl mercaptans, etc.;
For example:

60) 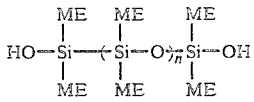
(IX)

61) 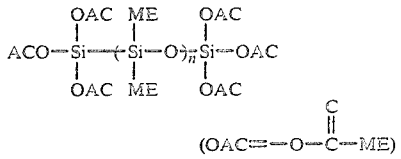
(X)

62) 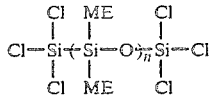
(XI)

63) 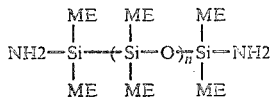
(XII)

64) 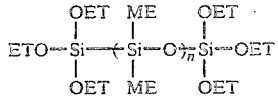
(XIII)

65) 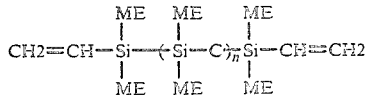
(XIV)

-continued

66) 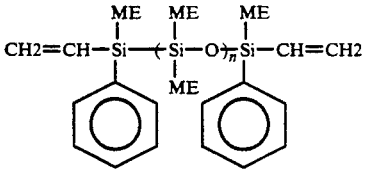 (XV)

67) 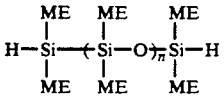 (XVI)

68) 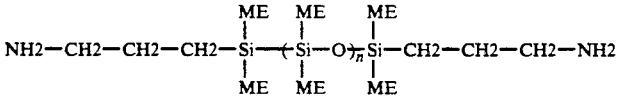 (XVII)

69) 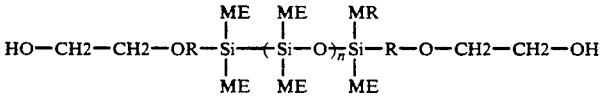 (XVIII)

70) 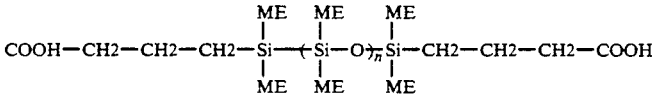 (XIX)

2-2) Polymethylhydrosiloxanes with general structure

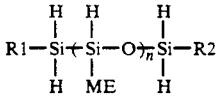 (XX)

For example:

71) polymethylhydro-dimethylsiloxane copolymer
72) Polymethylhydro-methylcyanopropylsiloxane copolymer
73) Polymethylhydro-methyloctylsiloxane copolymer
74) Polyethylhydrosiloxane
75) Polymethylhydrosiloxane-diphenylsiloxanedimethylsiloxane terpolymer 2-3) Polymethylalkylsiloxanes with general structure

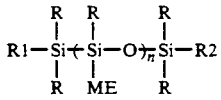 (XXI)

R=alkyl, alkoxy, cyanoalkyl, aminoalkyl, halogenated alkyl.

$R_1$,$R_2$=Hydrogen, —OH, alkyl, alkoxy, carboxy—COOH, halogens, aminoalkyl, aryl, aryl with general substituent functional groups.

For example:

76) Polymethylethylsiloxane
77) Polymethyloctylsiloxane
78) Polymethyloctadecylsiloxane
79) Polymethyldecyl-diphenylsiloxane copolymer
80) Polymethyl(phenethylsiloxane)-methylhexylsiloxane copolymer All of these polymers, #76–80, above, are trimethylsiloxy terminated 81) Polymethyl(phenethylsiloxane), vinyldimethylsiloxy terminated
81bis) Polymercaptopropylmethylsiloxane
81bisbis) Polycyanopropylmethylsiloxane ( 2-4) Poly aromatic-containing siloxanes with general structure (XXII):

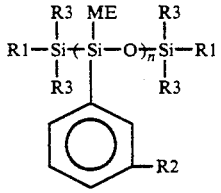 (XXII)

Where $R_1$, $R_2$, $R_3$=hydrogen, —OH, alkyl, amino, aminoalkyl, carboxylic-COOH, alkoxy, For example:

82) Polymethylphenylsiloxane, trimethylsiloxy terminated
83) Polydimethylsiloxane(4–6%)tolylmethylsiloxane copolymer
84) Polydimethyl-tetrachlorophenyl siloxane copolymer
85) Polydimethyl-phenylmethylsiloxane copolymer
86) Polydiphenylsiloxane, silanol terminated
87) Polydimethyl-diphenylsiloxane copolymer, silanol terminated
88) Polydimethyl-diphenylsiloxane copolymer, vinyl terminated
89) Polyphenylsilsesquioxane 2-5) Polyfluoroalkylmethylsiloxanes with general structure (XXIII):

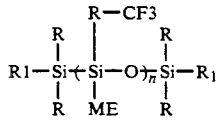 (XXIII)

For example:

90) Polymethyl-3,3,3-trifluoropropylsiloxane
91) Polymethyl-1,1,2,2-tetrahydro-perfluorooctyl-siloxane 3) Porous filler containing silicon atoms, including fumed silica, hydrophilic treated silica, hydrophobic treated silica, SiC and SiN, with particle sizes in the range of 10nm - 10 um.

The amount of silicon stabilizer in the hydroxy binder may be varied from 0.1-95 weight % for polysiloxanes, 0.1-60weight % for organo-silanes, and 0.1-50 weight % for porous fillers containing silicon atoms.

The following worked Examples will further clarify the uniqueness of my invention.

EXAMPLE 1 (Prior Art)

16 grams of x-type, metal-free phthalocyanine and 144 grams of tetrahydrofuran (THF) solvent were milled together in a jar roll mill with 3 mm dia. zirconium beads. The jar was rolled at 10 rpm for 36 hours to obtain suspension A.

84 grams of polyvinyl butyryl (PVB - available from Aldrich Chemical Co.) was dissolved in 356 grams of THF solvent and stirred with a magnet bar stirrer until a clear solution was obtained. The clear solution was then added to suspension A and milled for 30 additional minutes to obtain mixture B. After being separated from the Zr beads, mixture B was coated onto a nickelized 4 mil thick Mylar TM sheet using a wound wire rod. The coated sheet was dried in an oven at 120° C. for 2 hours. The thickness of the resulting OPC film was about 10 um.

OPC SCREENING TEST

Two OPC samples prepared as above were mounted in the sample holders of an OPC turntable test stand depicted schematically in FIG. 1. The test stand was a Monroe Electronics Co. Charge Analyzer 276A, the set-up and use of which are well-known in the electrophotographic industry. The samples were rotated at 1,000 rpm and exposed at one location in their revolution to a +6000 V corona charger to receive a positive charge. At a subsequent location in their revolution, the samples were exposed to a halogen light source equipped with an interference filter, neutral filter and cut-off filter to provide a narrow wavelength band light of 780 nm. The light illuminated the positively charged OPC samples. The surface potential of the OPC samples were measured and recorded in graphs like those depicted in FIGS. 3A and 3B. The potential Vo is measured as the charge acceptance after 35 seconds of being charged, and the potential Ve is measured as the dark decay after being left to discharge for 10 seconds in the dark. The steep photo discharge curve corresponds to an exposure time of 15 sec.

Figure 2:
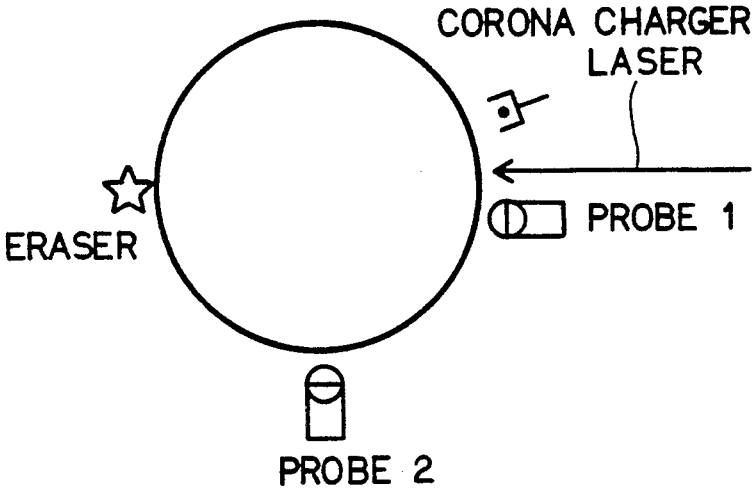
FIG. 2 is a schematic representation of an OPC writing life test stand used in my worked Examples.

In order to study the electrical stability of the OPC samples prepared as above, they were wrapped around a 135 mm dia. aluminum drum of a laser testbed printer built by Hewlett-Packard Co. and depicted schematically in FIG. 2. The OPC samples on the drum were positively charged at the corona with +400uA and then rotated clockwise past the laser beam location to the first electrostatic probe 1, a Trek Co. Model #360, to measure the OPC surface potential. Measurements at probe 1, after passing through the laser beam location, were made of 0% laser (laser is off) and 100% laser (laser is on), for $V_1(0)$ and $V_1(100)$, respectively.

A second electrostatic probe 2 located at the developer station permits corresponding surface potential measurements there of $V_2(0)$- laser is off and $V_2(100)$ - laser is on. After 1000 cycles on the life test stand, the used samples are removed and measured again on the screening test stand or compare their performance before and after the life test.

RESULTS

Figure 3B:
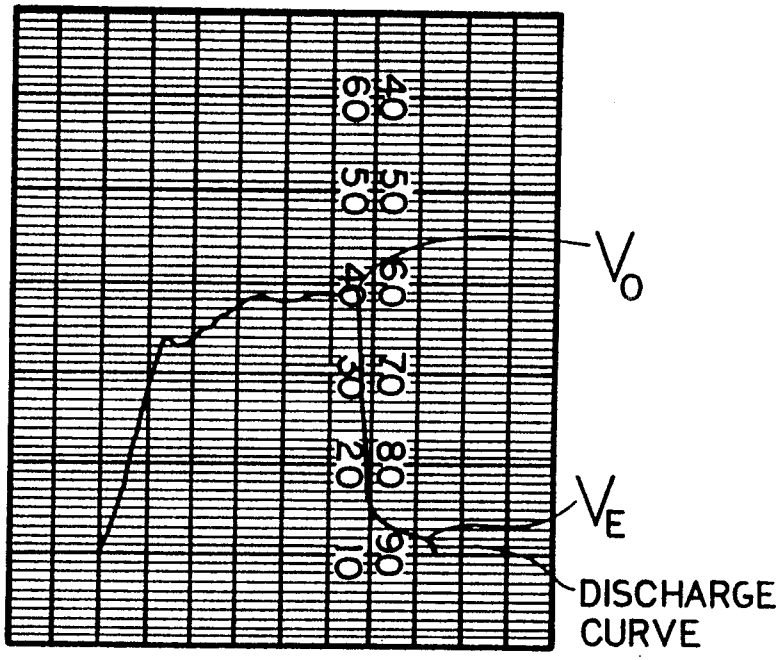
FIGS. 3A and 3B are charging and discharging curves from worked Examples on the OPC screening test stand depicted in FIG. 1.
Figure 3A:
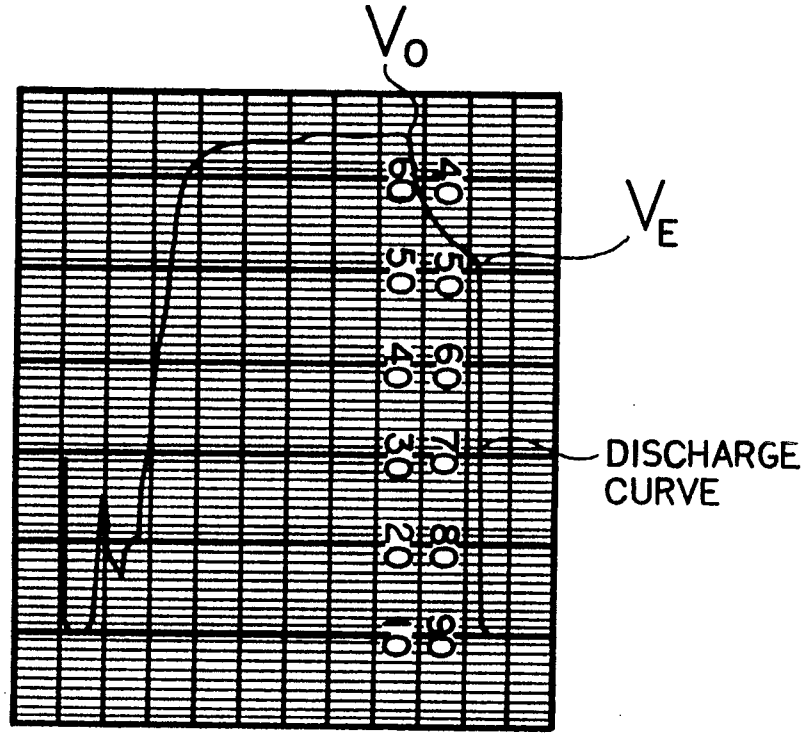

FIGS. 3A and 3B depict charging and discharging curves for one of the samples prepared above, after 1 cycle (fresh) and after 1000 cycles (used), respectively, on the life test stand. It is apparent from these measurements that the OPC exhibits a significantly increased dark decay. For example, the used sample depicted in FIG. 3B holds only about 5% of the charge after dark discharge, while the fresh sample depicted in FIG. 3A holds about 75% of the positive charge received from the corona.

Figure 4A:
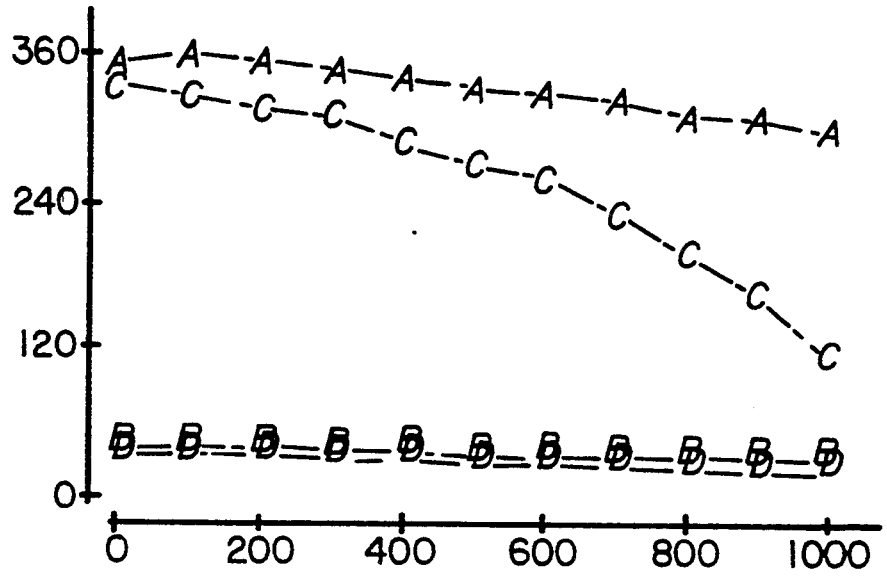
FIGS. 4A and 4B are stability curves from worked Examples on the OPC writing life test stand depicted in FIG. 2.

FIG. 4A depicts the variation in $V_1(0)$—item A in the FIG., $V_2(0)$—item C in the FIG. $V_1(100)$—item B in the FIG., $V_2(100)$—item D in the FIG. of the OPC sample prepared as above during 1000 cycles of testing on the life test stand. It is apparent from these measurements that $V_1(0)$ and $V_2(0)$ significantly decrease during the test, indicating that the OPC is less able to accept the positive charge from the corona, and less able to hold the accepted charge during the dark discharge period. This Example clearly shows the electrical instability of the prior art OPC.

EXAMPLE 2 (Invention)

An OPC, like the one from Example 1, above, was prepared, except that 17 grams of polydimethyl-siloxane, a reactive stabilizer component of relatively low molecular weight, available from Dow Corning Syloff as their product number 7600, was added in the clear solution of the polyvinyl butyryl binder. Also, 0.85 grams of the Dow Corning Syloff catalyst product number 7601 was added to the clear solution to encourage the cross-linking reaction between the binder and the stabilizer components.

EXAMPLE 3 (Invention)

A clear solution composed of 17 g of low molecular weight polydimethyl-siloxane (Dow Corning Syloff #7600), 0.85 gram of catalyst (Dow Corning Syloff #7601) and 300 grams of octane solvent was overcoated on the top of the OPC prepared in Example 2 above. The overcoat was dried at 120° C. for 2 hours to obtain a top coat 3 um thick.

The dark decay of the fresh sample (DD(1)) and used sample (DD(1000)) from Examples 1 and 2 above, and this Example 3, was measured in the OPC screening test and is reported in Table 1.

TABLE I

| Example # | DD (1) | DD (1000) |
|---|---|---|
| 1 | 75% | 5% |
| 2 | 75% | 67% |
| 3 | 80% | 80% |

Figure 4B:
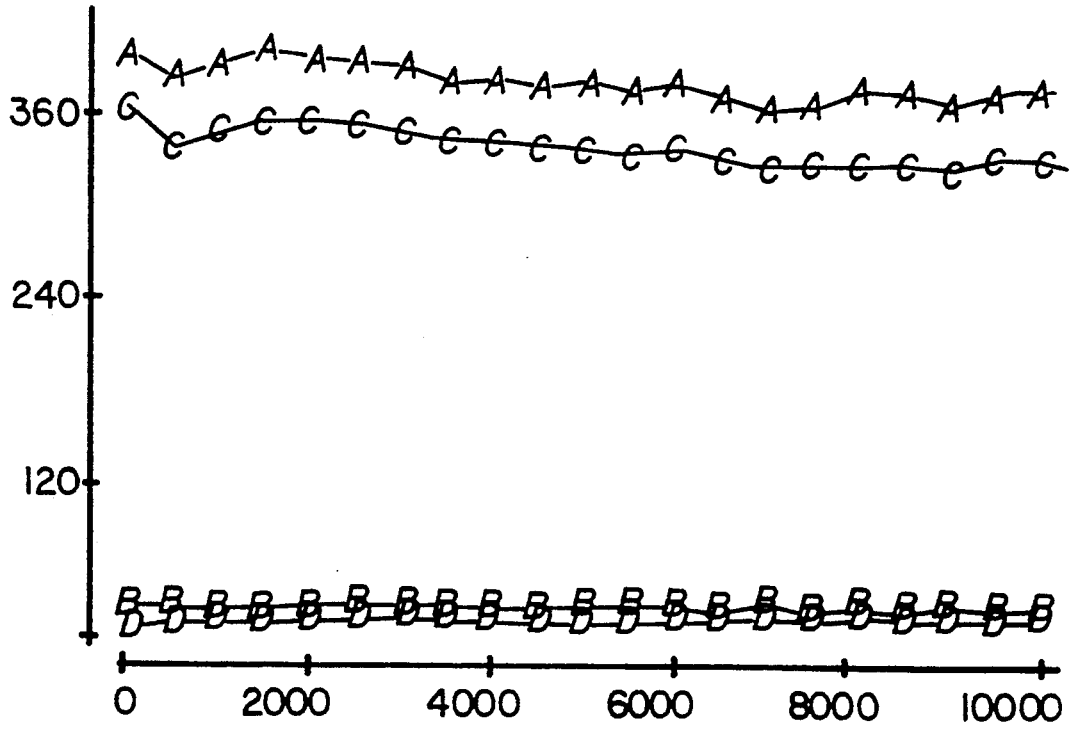

The stability of the OPC from Example 2, above, was measured in the OPC life test and is reported in FIG. 4B.

From these results, it is apparent that addition of the reactive stabilizer in the OPC significantly improves its charge retention ability. The overcoat of the OPC with the stabilizer further stabilized the surface charge of the OPC. No increase in residual voltage was observed from the stabilizer overcoat.

EXAMPLE 4 (Prior Art)

Example 2 above was repeated, except that the specific silicon resin was replaced by several different types of polymers soluble in alcohol and toluene. The results are reported in Table 2.

TABLE 2

| Polymeric Additive | DD (1) | DD (1000) |
|---|---|---|
| Polyvinylacetate | 65% | 3% |
| Polymethylmethacrylate | 78% | 5% |

From Table 2 it is apparent that these polymeric additives are not effective in stabilizing the electrical properties of the phthalocyanine/binder OPC.

EXAMPLE 5 (Invention)

16 grams of x-type, metal-free phthalocyanine pigment and 10 grams of glycidoxypropylmethyldiethoxysilane (listed as No. 6 compound in the alkoxy silanes group) and 144 grams of THF were milled together to prepare a premix using the milling procedure described in the EXAMPLE 1. In the same manner as this Example, the polyvinyl butyral solution was added and milled to achieve the coating solution B1. The life test result for this formulation is described in Table 3.

EXAMPLE 6 (Invention)

The test in Example 5 was repeated, except that the reactive silane compound No. 6 is replaced by a hydrophobic colloidal silica, Nihon Aerosil R974.

The life test result for this formulation is also described in Table 3.

EXAMPLE 7 (Invention)

The coating solution for this was made by mixing 70% wt of the solution of EXAMPLE 2, 20% wt of the solution of EXAMPLE 6 and 10% wt of the solution of the EXAMPLE 5. The mixture was slightly stirred with a stir bar using a magnet stirrer for 30 minutes. After that, the mixture was left still to incubate for 7 days. The solution was then coated on luminized Mylar TM substrate using a wound wire bar so that the total thickness was about 10 um when dried. The coating layer was dried at room temperature for 10 minutes, and then baked in an oven at 130° C. for another 2 hours. The life test result for this formulation is also described in Table 3.

RELEASE PROPERTIES TEST

In order to test the release properties of the OPC surface, a hand made release tester was used. In this procedure, a scotch tape was pressed on the determined area surface of the OPC and then a perpendicular peeling force was measured. The practical release surface only required a peeling force less than 10 dyne. The release test result of the Example 1, 2, 3, 5, 6, 7 are described in the Table 3.

TABLE 3

| Example # | DD (1) | DD (1000) | Peeling force |
|---|---|---|---|
| 1 | 75% | 5% | 70 dyne |
| 2 | 75% | 67% | 4 dyne |
| 3 | 80% | 80% | 2 dyne |
| 5 | 76% | 66% | 9 dyne |
| 6 | 76% | 69% | 9 dyne |

TABLE 3-continued

| Example # | DD (1) | DD (1000) | Peeling force |
|---|---|---|---|
| 7 | 90% | 90% | 2 dyne |

From this table, one can recognize that the combination of polymeric silicon stabilizer such as polydimethylsiloxane with low molecular weight silicon stabilizers such as silane and silica, can improve significantly the charge stability of the single layer photoreceptor. Also, one can see that the release properties of the surface of the multiple component of silicon stabilizer photoconductor in Example 7 is superior to the single component of silicon stabilizer in Examples 2, 5 and 6.

EXAMPLE 8 (Invention)

16 grams of x-type, metal-free phthalocyanine pigment, 1.96 grams of silanol terminated polydimethyl siloxane (molecular weight 6,000), 0.56 gram of hydrophobic colloidal silica R974 (Nihon aerosil), 0.28 gram of tetramethoxy silane (compound 13 in the alkoxy silane list) and 144 grams of THF were mixed together by the milling procedure described in Example 1, to obtain suspension C.

84 grams of polyvinyl butyral B-98 from Monsanto Chemical Co. was dissolved in 356 grams of isopropyl alcohol (IPA). The clear solution was then added into the solution C and milled for 30 additional minutes to obtain mixture D.

After being separated from the Zr beads, the mixture was left still to incubate for 14 days. The mixture was coated on an aluminized Mylar TM substrate (4 mil thick) using a wound wire rod. The coated sheet was dried at room temperature at 55% relative humidity for 24 hours, dried at 130° C. for 4 hrs., and then relaxed at room temperature in the dark for 48 hours.

The sample exhibited an excellent release surface with a peeling force of only 1 dyne.

The sample was tested in the Life Test described in Example 1, and exhibited excellent charge, discharge with 80% power of laser diode for 500,000 cycles without any significant changes in the contrast potential.

EXAMPLE 8 bis

The test in Example 8 was repeated, except that the lower hydroxy content polyvinyl butyral binder B-76, from Monsanto Chemical Co. was used. The life test results are described below:

| Example # | Hydroxy binder | Hydroxy content | DD (1) | (DD1000) |
|---|---|---|---|---|
| 8 | B-98 | 18-20% | 85% | 84% |
| 8bis | B-76 | 10% | 92% | 68% |

This Example makes it clear that hydroxy is required for this invention.

EXAMPLE 8 bisbis

The test in Example 8 was repeated, except that the polyvinyl butyral was replaced by a phenoxy resin, UCAR PKHH from Union Carbide Co. In this case, due to the poor solubility of phenoxy resin in alcohol, THF was used as solvent for dissolving the phenoxy resin. The life test result is described below:

| Example # | DD (1) | DD (1000) |
|---|---|---|
| 8bisbis | 85% | 79% |

This Example makes it clear that phenoxy resin is appropriate for this invention.

EXAMPLE 9 (Invention)

The test in Example 1 was repeated, except that a copolymer of polyvinyl butyral and siloxane (Shinetsu silicon was used instead of polyvinyl butyral.

The sample exhibits DD(1)=79% and DD(1000)=75% with a release surface peeling force of 8 dynes.

EXAMPLE 10–12 (Invention)

The test in Example 8 was repeated, except that the silane compounds were changed for each test. The life test results are described in Table 4.

TABLE 4

| Example # | Silane No. compound | DD (1) | DD (1000) |
|---|---|---|---|
| 10 | 34/ dimethyldichlorosilane | 73% | 75% |
| 11 | 40/ hexamethylsilazane | 84% | 83% |
| 12 | 50/ dimethylaminomethyl vinylsilane | 89% | 85% |

EXAMPLE 13–27 (Prior Art)

The test in Example 1 was repeated, except that x-type, metal-free phthalocyanine was replaced by copper phthalocyanine (alpha-and beta-CuPc), haloindium pigment (halogen=Bromide, Chloride, BrInPc,ClInPc), acid-pasted titanyl phthalocyanines (TiOPc, TiOPcF4, TiOPc C14). The life test results are described in Table 5.

TABLE 5

| Example # | Compound | DD (1) | DD (1000) |
|---|---|---|---|
| 13 | alpha-CuPc | 92% | 10% |
| 14 | beta-CuPc | 73% | 2% |
| 15 | ClInPc | 75% | 5% |
| 16 | ClInPcCl | 78% | 4% |
| 17 | BrInPc | 79% | 4% |
| 18 | BrInPcCl | 65% | 1% |
| 19 | BrInPcF4 | 90% | 3% |
| 20 | alpha TiOPC | 78% | 5% |
| 21 | amorphous TiOPc | 79% | 4% |
| 22 | amorphous TiOPcF4 | 84% | 5% |
| 23 | AlClPcCl | 67% | 1% |
| 24 | VOPc | 54% | 3% |
| 25 | (VOPc + TiOPc) mix | 79% | 5% |
| 26 | (TiOPc + TiOPcF4) mix | 76% | 3% |
| 27 | (TiOPc + TiOPcCl4) mix | 94% | 2% |

EXAMPLE 28–42 (Invention)

The test in Example 8 was repeated, except that x-type, metal-free phthalocyanine pigment is replaced by the pigment utilized in the Example 13–27. The improved life test result is described in Table 6.

TABLE 6

| Example # | Compound | DD (1) | DD (1000) |
|---|---|---|---|
| 28 | alpha-CuPc | 90% | 85% |
| 29 | beta-CuPc | 78% | 82% |
| 30 | ClInPc | 79% | 80% |
| 31 | ClInPcCl | 79% | 80% |
| 32 | BrInPc | 77% | 74% |
| 33 | BrInPcCl | 75% | 84% |
| 34 | BrInPcF4 | 92% | 73% |

TABLE 6-continued

| Example # | Compound | DD (1) | DD (1000) |
|---|---|---|---|
| 35 | alpha TiOPC | 98% | 75% |
| 36 | amorphous TiOPc | 89% | 84% |
| 37 | amorphous TiOPcF4 | 86% | 85% |
| 38 | AlClPcCl | 77% | 71% |
| 39 | VOPc | 74% | 69% |
| 40 | (VOPc + TiOPc) mix | 89% | 77% |
| 41 | (TiOPc + TiOPcF4) mix | 86% | 73% |
| 42 | (TiOPc + TiOPcCl4) mix | 97% | 82% |

While there is shown and described the present preferred embodiment of the invention, it is to be distinctly understood that this invention is not limited thereto but may be variously embodied to practice within the scope of the following claims.

I claim:

1. An organic photoconductor for positive charging, said photoconductor having improved surface release characteristics, and comprising:

a conductive substrate component;

a water insoluble hydroxy-containing binder component forming a layer greater than or equal to about 1 micron thick on said substrate;

a phthalocyanine pigment component having the general structure:

$$M—PcX_n \quad (A)$$

where

M=hydrogen (metal free), Cu, Mg, Zn, TiO, VO, InY (Y=halogen, Cl, Br, I, F)

X=halogen (Cl, Br, I, F), nitro —$NO_2$, cyano—CN, sulfonyl —$SO_2$alkyl, alkoxy, and

N=0–4, said phthalocyanine pigment being uniformly distributed throughout said binder component;

a reactive stabilizer component selected from the group of polysiloxanes, organo-silane compounds and porous fillers containing silicon atoms, said reactive stabilizer component also being uniformly distributed throughout said binder component; and, said photoconductor being prepared by a curing process which includes thermal curing, moisture or hydrolysis curing, and radiation curing, the latter including UV, X-ray and electron beam curing.

2. The photoconductor of claim 1 wherein the hydroxy-containing binder is selected from the group of polyvinyl acetals, phenolic resins, phenoxy resins, cellulose and its derivatives, copolymers of vinyl alcohol, hydroxylated polymers, and copolymers of hydroxy monomers and silicon resins.

3. The photoconductor of claim 1 wherein the phthalocyanine pigment has a particle size of less than one micron with absorption maxima in the infrared or near infrared range.

4. The photoconductor of claim 1 wherein the phthalocyanine pigment component is a combination of two or more types of phthalocyanine pigments.

5. The photoconductor of claim 1 wherein the reactive stabilizer component is a polysiloxane selected from the group having the general formula:

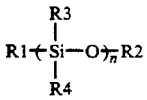

(B)

Where $R_1$, $R_2$=hydrogen, hydroxy —OH, amino —$NH_2$, alkyl, amino-alkyl, carboxylic, carbinol, aryl, arylamino;

$R_3$, $R_4$=hydrogen, alkyl, fluoroalkyl, aryl, and $n>50$.

6. The photoconductor of claim 5 wherein the polysiloxane is a combination of two or more types of polysiloxanes.

7. The photoconductor of claim 1 wherein the reactive stabilizer component is an organo-silane compound selected from the group having the general formula:

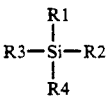

(C)

Where $R_1$, $R_2$, $R_3$, $R_4$=hydrogen, alky, alkoxy, aryl, alkene, amino, halogen, hydroxy, carboxilic, acetate, alkene, oxide, mercapto, ether, fluoroalkyl, cyano and cyanoalkyl.

8. The photoconductor of claim 7 wherein the organo-silane compound is a combination of two or more types of organo-silane compounds.

9. The photoconductor of claim 1 wherein the porous fillers containing silicon atoms are selected from the group of hydrophillic colloidal silica, hydrophobic colloidal silica, SiC powder and SiN powder.

10. The photoconductor of claim 9 wherein the porous filler is a combination of two or more types of porous fillers.

11. The photoconductor of claim 1 wherein the solution for coating has been kept calm for at least 3 days prior to coating.

12. The photoconductor of claim 1 wherein the phthalocyanine pigment component is present in the range of about 8 wt. % to about 50 wt. % relative to the hydroxy-containing binder component.

13. The photoconductor of claim 1 wherein the reactive stabilizer component is present in the range of about 0.0015 wt. % to about 95 wt. %, relative to the hydroxy-containing binder component.

14. The photoconductor of claim 1 wherein the hydroxy-containing binder layer is formed on the substrate from a solution containing an alcohol component.

15. The photoconductor of claim 1 wherein the phthalocyanine pigment component is formed from a premixed suspension with a solvent.

* * * * *